United States Patent [19]

Pitts

[11] 4,384,685

[45] May 24, 1983

[54] TEXTILE STRAND SUPPORT BOBBIN

[75] Inventor: Bobby L. Pitts, Wellford, S.C.

[73] Assignee: Bobby L. Pitts, Wellford, S.C.

[21] Appl. No.: 285,832

[22] Filed: Jul. 22, 1981

[51] Int. Cl.[3] ..... B65H 54/54; B65H 75/10

[52] U.S. Cl. ..... 242/46.21; 242/118.3; 242/118.32

[58] Field of Search ..... 242/46.21, 46.2, 46.3, 242/118.3, 118.31, 118.32; 57/102, 129, 130

[56] References Cited

U.S. PATENT DOCUMENTS

| | | | |
|---|---|---|---|
| 102,587 | 5/1870 | Pearl | 242/46.21 X |
| 192,493 | 6/1877 | Draper | 242/46.21 |
| 2,615,650 | 10/1952 | Betner et al. | 242/118.32 |
| 3,167,262 | 1/1965 | Adams et al. | 242/46.21 |
| 3,878,997 | 4/1975 | Adams et al. | 242/46.21 |
| 3,958,776 | 5/1976 | Torzo | 242/118.32 |

*Primary Examiner*—Stanley N. Gilreath
*Attorney, Agent, or Firm*—Luke J. Wilburn, Jr.; Wellington M. Manning, Jr.

[57] ABSTRACT

A one-piece, unitarily molded plastic bobbin for support of indefinite length strand material wound in package form thereon, comprising a tubular member having a generally cylindrical exterior surface for receipt of the strand material, and an opening and passageway therethrough for receipt of a rotatable drive spindle. One end portion of the bobbin contains an internal wall member for receiving an upper end portion of the spindle in driving engagement therewith. A major portion of the length of the interior passageway of the bobbin between the ends thereof having a transverse dimension sufficiently larger than the external transverse cross-sectional dimension of the drive spindle to permit radial contraction of the tubular member during the strand winding operation, and the lower open end portion of the bobbin passageway is of reduced transverse cross-sectional dimension with respect to the major portion of the length of the passageway so that the lower end of the bobbin closely surrounds and engages the drive spindle to facilitate stability and support of the bobbin on the spindle during the winding operation.

5 Claims, 5 Drawing Figures

TEXTILE STRAND SUPPORT BOBBIN

The present invention relates to an improved support bobbin for collecting strand material in package form during a winding operation, and, more particularly, to a one-piece, unitarily molded plastic support bobbin particularly adapted to collect textile roving in package form at the winding position of a textile roving frame.

BACKGROUND OF THE INVENTION

It is a conventional and well known practice to collect textile strand materials on a support tube, or bobbin, at various stages of a textile yarn manufacturing operation. In particular, in the collection of textile roving strands produced on a textile roving frame, such as on a Saco-Lowell Rovematic machine, the roving strands are continuously wound onto relatively large tubular bobbins, each of which is supportably received on and driven in rotation by a vertically disposed spindle to build the roving in a series of overlapping layers on the the surface of the bobbin.

Each drive spindle has a cylindrical main body and central vertically movable shaft, the upper end of which drivingly engages an upper end portion of the bobbin to rotate and vertically reciprocate the bobbin along the spindle main body past a horizontally fixed-position flyer which revolves about the bobbin to guide the roving onto the bobbin during its collection. A major portion of the interior wall of the bobbin through which the drive spindle extends is spaced from the adjacent guide surface of the spindle main body to permit radial contraction of the bobbin under force of tension exerted by the roving strand during winding and to facilitate removal of the bobbin from the spindle during doffing operations.

The lower end portion of the bobbin which reciprocates up and down along the guide surface of the spindle main body is of reduced internal diameter to closely surround and engage the adjacent outer surface of the spindle, thus providing stability of the bobbin during its rotation and proper guidance of the same on the spindle during the winding operation.

It is a current practice to manufacture tubular bobbins of the type described out of plastic in a molding operation. Typically the bobbin-forming molds comprise a pair of mating female mold parts which form a cavity to shape the exterior surfaces of the bobbin, and a male core, or force, of one piece construction which resides in the female cavity to form the shape of the interior surface of the bobbin. In such mold forming equipment employing a one piece force or core, it is necessary that the interior shape of the tubular bobbin formed in the mold be such as to permit withdrawal of the core from the bobbin after molding. For this reason, it has been the practice and deemed necessary to mold such plastic support bobbins in two separate pieces, a main tubular body having an internal passageway of uniform or slightly increasing internal diameter toward the open end of the bobbin from which the core must be removed, and a separate smaller diameter plastic ring which is thereafter inserted into and adhesively secured in the open end of the tubular main body, as by friction heat bonding, to provide the aforesaid reduced internal diameter portion at the base of the bobbin to closely surround the drive spindle and stabilize the bobbin during its rotation. Such a two piece construction not only adds to the cost of the manufacture of the bobbins, but the plastic ring inserts tend to accumulate lint at their surfaces of juncture with the main body of the bobbin. A build-up of lint on the interior surface of the bobbin often causes the bobbin to jam on the drive spindle during its vertical travel along the spindle main body, producing an unstable condition requiring shut-down of the roving frame to correct the situation. Such hang-up or drag of the bobbin on the drive spindle can also cause the bobbin to be thrown off the drive spindle with resultant danger to operators in the vicinity of the roving frame.

OBJECTS OF THE INVENTION

It is therefore an object of the present invention to provide an improved bobbin of one-piece, unitarily molded plastic construction which eliminates the problems inherent with the aforementioned plastic bobbin constructions of the two piece removable ring insert type.

It is another object to provide an improved one-piece plastic bobbin of the type described wherein the bobbin may be manufactured by use of conventional one piece male core molding equipment of the type presently employed in the art.

SUMMARY OF THE INVENTION

Briefly, the present invention comprises a one-piece, unitarily molded plastic bobbin for collecting textile strand material, in particular, textile roving, wherein the bobbin is rotatably driven on a drive spindle of a roving frame. The bobbin comprises a generally cylindrical tube having an outer surface for receipt of strand material thereon, and an internal passageway therethrough, the transverse dimensions of which are reduced adjacent both ends of the bobbin to permit its driving engagement by and positional stabilization on the spindle, while the major portion of the interior passageway of the bobbin between these ends are of increased diameter to permit radial contraction of the walls of the bobbin under forces of tension of the strand material being wound on the bobbin.

Heretofore it has not been thought possible to satisfactorily commercially produce unitarily molded bobbins of the construction described because of the inability to remove the male core, or force, from the bobbin without damage to the bobbin product. However, I have found that such a unitarily molded bobbin can be produced on molding equipment employing a solid male core, or force, by providing certain dimensions to the end portion of the molded bobbin which enables easy and effective removal of the core without consequent damage to the product.

BRIEF DESCRIPTION OF THE DRAWINGS

The above as well as other objects of the present invention will become more apparent and the invention will be better understood from the following detailed description of preferred embodiments thereof, when taken together with the accompanying drawings, in which.

DETAILED DESCRIPTION OF PREFERRED EMBODIMENTS

Figure 1:
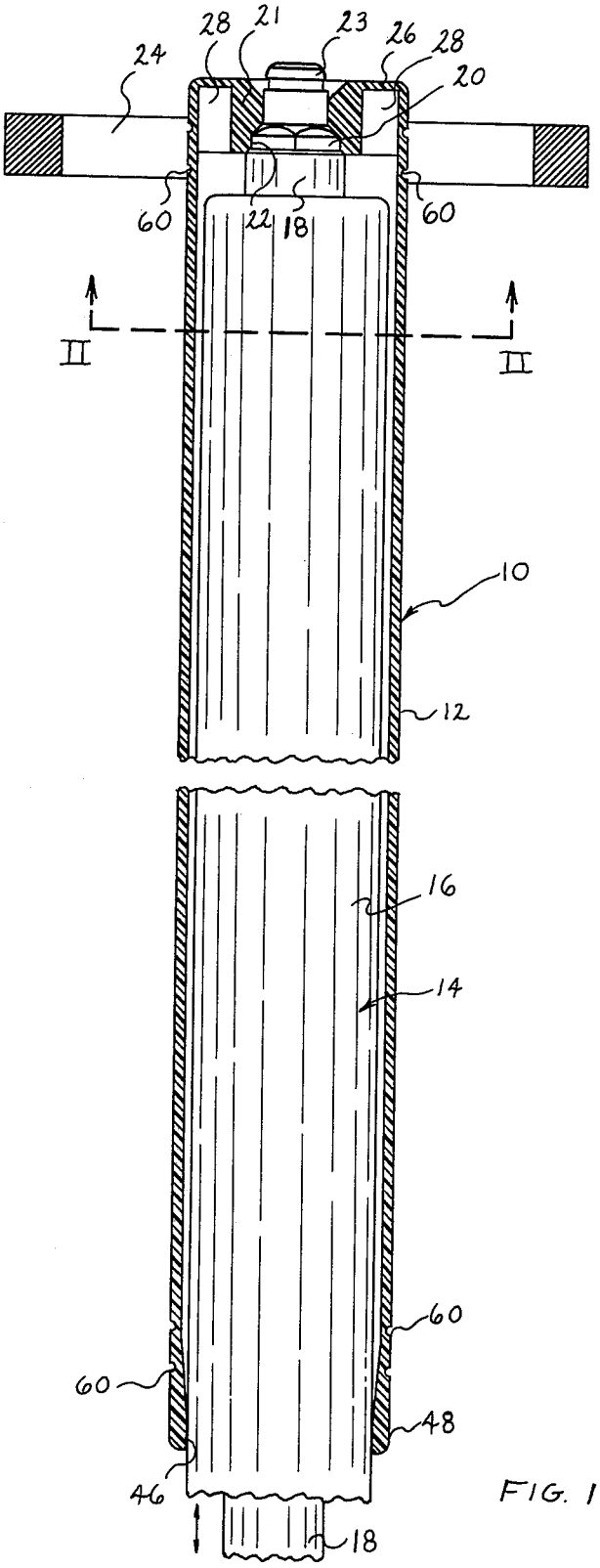
FIG. 1 is a schematic front elevation view of a bobbin of the present invention shown mounted for rotation and reciprocation on a conventional rotatable drive spindle mechanism of a textile roving frame, with the bobbin shown in vertical cross section and a midportion of the bobbin and drive spindle mechanism broken away for convenience.

Referring more specifically to the drawings, FIG. 1 shows a preferred form of embodiment of a bobbin 10 of the present invention which is employed to collect an indefinite length strand of textile material, such as a textile roving, in a series of overlapping layers thereon to form a roving package. Bobbin 10 comprises a generally elongate cylindrical tubular member 12 of unitarily molded plastic construction having a central passageway extending axially therethrough. The bobbin is supportably received on a rotatable drive spindle 14 of a conventional textile roving frame, such as the "Rovomatic" type roving frame manufactured and sold by Saco-Lowell Corporation.

Figure 2:
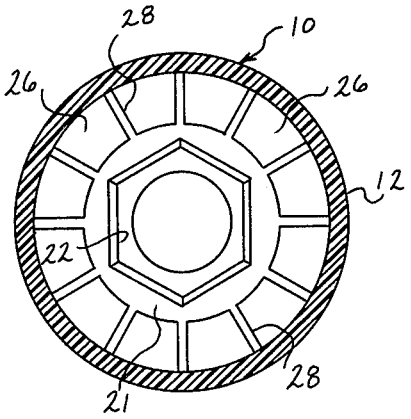
FIG. 2 is an enlarged horizontal cross sectional view of the bobbin only, taken along line II—II of the bobbin of FIG. 1 and looking in the direction of the arrows.

As is well known in the art, the roving frame drive spindle 14 comprises a cylindrical main body 16 containing a central shaft 18 which extends therethrough and is vertically reciprocated relative to the main body 16 during the winding operation. Shaft 18 of the drive spindle is provided with an upper portion 20 of hexagonal horizontal cross-section which is drivingly received within an internal wall member 21 unitarily formed with tubular member 12 and defining a corresponding hexagonally shaped passageway portion 22 of reduced diameter through the bobbin adjacent its upper end (FIGS. 1 and 2). The smaller upper end 23 of shaft 18 extends through a further reduced diameter portion of wall member 21 at the upper end of the bobbin passageway to facilitate support and securement of the bobbin in driven relationship with the spindle as the spindle assembly including main body and shaft is rotated.

As is well known in the operation of the roving frame, during collection of a roving strand, the spindle shaft 18 and main body 16 are rotatably driven by suitable means, such as a drive belt, (not shown) which commonly drives a plurality of such bobbin-supporting spindles (not shown) on the frame. Spindle shaft 18 simultaneously reciprocates vertically upwardly and downwardly during its rotation to move the bobbin 10 relative to and along the spindle main body 16 while a roving strand is directed onto the outer surface of the spindle from a horizontally stationarily positioned ring flyer mechanism 24, thus causing the roving to be wound along the bobbin length in a series of overlapping layers.

Details of the construction of the interior upper end portion of the bobbin which is drivingly engaged by the spindle reciprocating shaft portion 20 are best shown in FIG. 2. As seen, the upper end of the bobbin passageway is partially closed by a radially inwardly extending end wall portion 26 with a series of vertically positioned radially extending partitions or fins 28 integrally molded with the wall portions 12, 21 and 26 to provide reinforcement for the central circular wall portion 21, the interior surface of which is of the hexagonal shape to receive spindle shaft portion 20 in driving engagement with the bobbin.

As best seen in FIG. 1, the internal diameter of the major portion of the length of the bobbin between the ends thereof is slightly larger than the external diameter of the cylindrical main body 16 of the spindle so that the bobbin tube may radially contract without binding on the drive spindle under tension forces imposed thereon by the roving strand. The lower end portion of the bobbin passageway is of reduced transverse dimension and diameter to closely surround and engage the main body 16 of spindle 14 during reciprocation of the bobbin vertically along the spindle in the winding operation, thus stabilizing and guiding the bobbin on the spindle to facilitate proper collection and build up of the roving during package forming operations. Details of the arrangement of the lower inner wall surface of the bobbin 10 will be described hereinafter.

Figure 5:
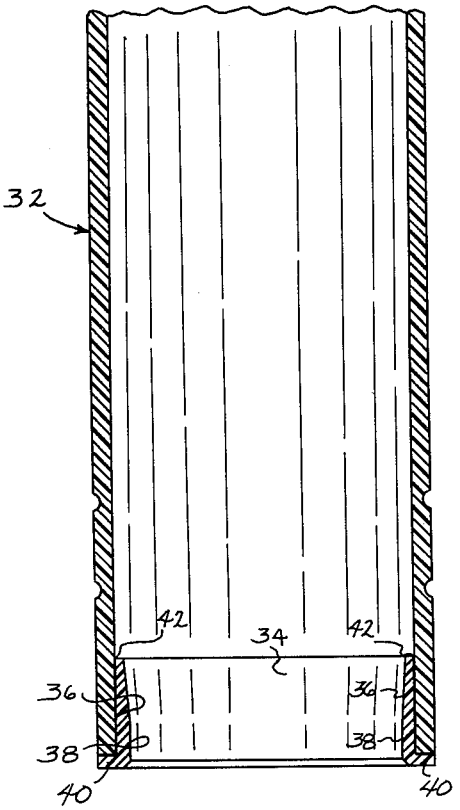
FIG. 5 (PRIOR ART)
FIG. 5 is an enlarged vertical cross-sectional view of the lower end portion only of a two-piece roving bobbin of the prior art.

In contrast to the unitary bobbin construction of the present invention, FIG. 5 is an enlarged vertical cross sectional view of the lower end portion of a two-piece plastic support bobbin 32 of the prior art. The upper portion of prior art bobbin 32 which is drivingly engaged by the spindle assembly of the roving frame is of substantially identical construction to that of the bobbin 10; however, the reduced diameter portion of the bobbin passageway at the lower end of bobbin 32 is achieved by a separate plastic ring insert 34 which is formed in a separate molding operation from the main body of the bobbin. As seen, the ring insert 34 has an internal inwardly tapered surface 36 terminating in a generally vertical straight wall portion 38 with radial flange 40. The insert closely engages a roving frame drive spindle to provide the necessary stability to the bobbin. The plastic ring insert is suitably secured in the lower end of the main body of the bobbin as by adhesively sealing the same thereto in a friction heat bonding operation.

As aforementioned, the bobbin 32 of the prior art, as illustrated by FIG. 5, has a tendency to accumulate textile lint and fibers, and cause a build up of the same at the line of juncture 42 of the ring 34 with the interior surface of the main body 38 of the bobbin. This accumulation and build up of lint causes the prior art bobbin to bind upon and become jammed on the main body of a drive spindle during the winding operation, resulting in improper package build, breaking of the roving strand being wound on the bobbin, and in some cases, oscillation and throw off of the bobbin from the drive spindle. If such a condition occurs, the throw off of the bobbin can create physical danger to operators of the roving frame in the vicinity thereof.

Figure 3:
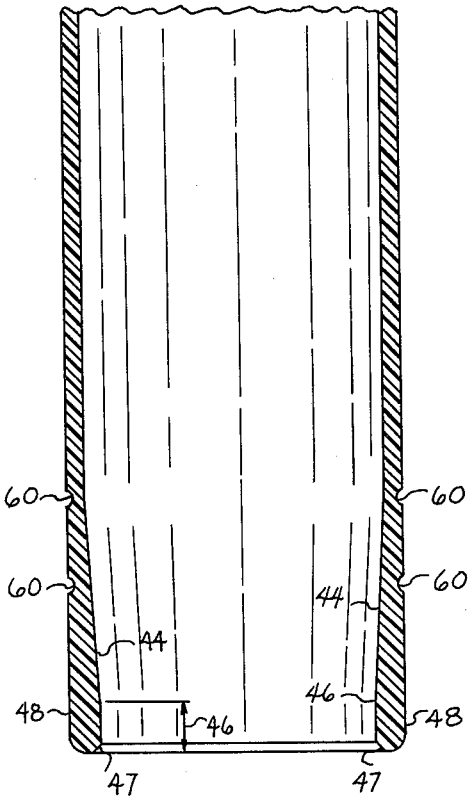
FIG. 3 is an enlarged vertical cross sectional view of the lower end portion only of the bobbin of FIG. 1.

In distinction to the two-piece plastic bobbin construction of the prior art, and as best illustrated in FIG. 3, the entire bobbin 10 of the present invention is of unitarily molded, one-piece construction. The inner wall surface portion 44 of bobbin tubular member 12 adjacent the open lower end of the tube passageway tapers inwardly to form an increased thickness in the wall of the bobbin and correspondingly reduce the internal diameter of the bobbin passageway so that the bobbin inner wall surface portion 46 at the end of the bobbin will generally closely conform to and engage the main body of the drive spindle. A slight chamfer 47 is provided at the extreme end portion of the bobbin passageway to facilitate its guidance onto the spindle.

Thus it can be seen that the major portion of the length of the bobbin between its ends on which the roving strand is collected is spaced from the main body 16 of the spindle so as to permit radial contraction of the bobbin under forces of roving tension, while the upper and lower end portions of the bobbin positively engage the respective adjacent portions of the spindle assembly to stabilize the bobbin during its rotation and reciprocation thereby.

To facilitate removal of the bobbin of the present invention from the conventional one-piece core molding apparatus without damage to the bobbin product, I have found that the bobbin surface portion 44 (FIG. 3) is preferably tapered inwardly at an angle of about 4 degrees, relative to the plane of the major inner wall surface portion of tubular member 12 and, correspondingly, to the longitudinal central axis of tubular member 12.

Figure 4:
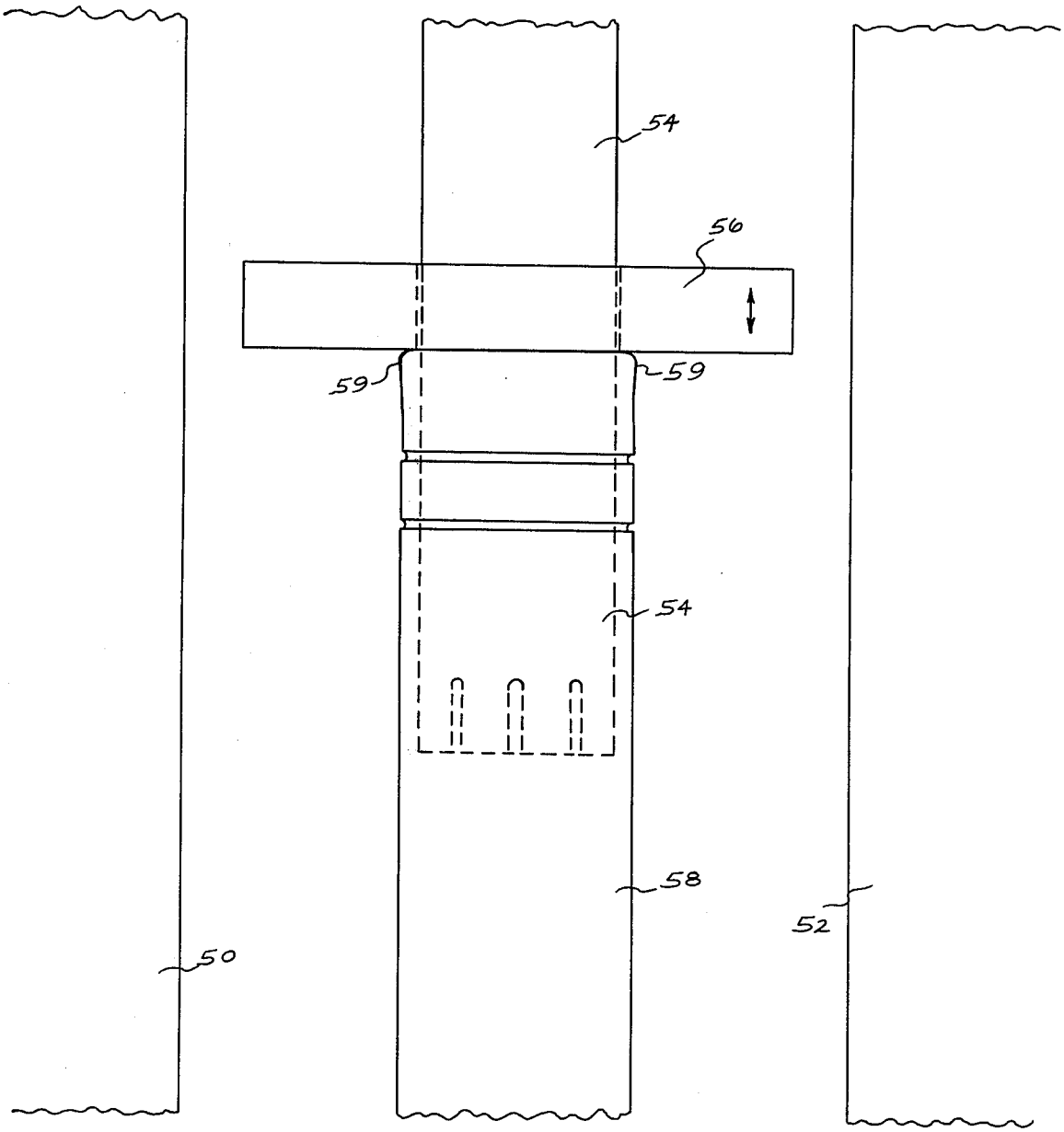
FIG. 4 is a schematic side elevation view, illustrating basically the manner in which the bobbin of the present invention is removed from the solid male core of a molding apparatus.

FIG. 4 illustrates conventional components of molding apparatus employed in the manufacture of bobbins of the present invention. As illustrated, a pair of female mold parts 50, 52 having appropriately shaped recesses (not shown) are supported and manipulated in known manner for horizontal movement toward and away from a male core member 54 to provide a bobbin-shaping cavity in which the male core resides. After charging and forming of the bobbin in the mold, and upon separation of the female parts 50, 52 a stripper plate 56 having a generally circular opening therethrough moves downwardly along core 54 in engagement with the end of the bobbin product 58 (the lower open end of the bobbin as seen in FIG. 1) to force the same in sliding relation off the core 54. The construction and general operation of the aforementioned male and female components and the stripper plate of the molding apparatus are well known in the art, do not form a part of the present invention, and details thereof are not included herein.

During the removal of the unitarily molded plastic bobbin from the male core by the stripper plate, the open lower end or base portion of the bobbin, as seen in FIG. 1, must necessarily expand, as illustrated at 59 in FIG. 4, and, accordingly, may be slightly permanently deformed outwardly due to its passage over the larger diameter central portion of the solid core. In such case, I have found it desirable to compensate for any such slight permanent deformation by shaping the recesses of the female mold parts 50, 52 to provide a slight inward taper of between about 2 to 2.5 degrees to the outer wall surface portion 48 of the bobbin, relative to the longitudinal axis of the bobbin, as it is formed in the molding apparatus. I have also found it desirable to shape the mold core member 54 to provide a very slight outward flare of the inner wall surface portion 46 of the bobbin of between about 0.5 to 1 degree, toward the open end of the bobbin and relative to the longitudinal axis of the bobbin, as the bobbin is formed and resides on the core. By initially molding the lower end portion of the bobbin, surfaces 46, 48, with the aforementioned taper and flare, the final bobbin product stripped from the core 54, due to its slight permanent deformation during removal from the core, will be provided with finally shaped wall surface portions 46, 48 which lie substantially parallel to each other and to the longitudinal axis of the bobbin and drive spindle on which the bobbin is rotatably mounted.

As is conventional in roving support bobbins of the type hereindescribed, the outer peripheral surface of the bobbin at each end thereof are provided with slough rings or grooves 60 which frictionally engage the roving strands at the inner surface of the package adjacent the ends of the bobbin to prevent sloughing of the roving strands from the yarn package.

From the foregoing description of preferred embodiments of the present invention, it can be seen that the one-piece unitarily molded plastic bobbin of the present invention may be formed in a conventional molding operation to eliminate the aforementioned problems in the two-piece plastic molded bobbin constructions of the prior art.

That which is claimed is:

1. A one piece unitarily molded plastic bobbin for support of indefinite length strand material wound in a series of layers to form a package thereon, comprising a unitary tubular member having a generally cylindrical exterior surface for receipt of the strand material, one end of said tubular member having an opening for receipt of a rotatable drive spindle, means located adjacent the other end of the tubular member defining a reduced transverse cross-sectional interior dimension of said tubular member for receiving an end portion of the spindle in driving engagement with the bobbin, a major portion of the length of the interior passageway of said tubular member between said spindle end portion receiving means and said one end having a transverse dimension sufficiently larger than the external transverse cross sectional dimension of the drive spindle to permit radial contraction of the tubular member inwardly toward the spindle during a strand winding operation, the interior passageway of said tubular member between said spindle end portion receiving means and said one end having a smooth surface to prevent accumulation of lint during winding of strand material, and the interior passageway of said tubular member immediately adjacent said one end having a reduced transverse cross sectional dimension with respect to said major portion of the length such that the tubular member closely surrounds the drive spindle adjacent said one end to facilitate stability and support of the bobbin on the drive spindle during a strand winding operation.

2. A bobbin as defined in claim 1 wherein a portion of the interior surface of said tubular member adjacent said one end tapers inwardly along the length of the member toward said one end to form an increased thickness in the wall of the tube immediately adjacent said one end.

3. A bobbin as defined in claim 2 wherein the interior transverse dimension of said major portion of the tubular member is of generally circular shape, the other end of said tubular member has an opening of reduced transverse cross sectional dimension with respect thereto, and wherein said spindle end-receiving means comprises wall means located in the tubular member passageway for being drivingly engaged by the end portion of the drive spindle for rotation therewith.

4. A bobbin as defined in claim 2 wherein the inner wall surface portion of the tubular member between said tapered portion and said one end lies substantially parallel to the longitudinal axis of the tubular member and is of generally uniform cross sectional internal diameter to closely conform to the external diameter of the spindle on which the tube is supportably placed.

5. A bobbin as defined in claim 2 wherein the inner surface of said major portion of the length of the interior of the tubular member is of cylindrical shape of generally constant diameter, and wherein said inwardly tapered interior surface portion of the tube tapers inwardly at an angle of about 4° with respect to longitudinal axis of the tubular member.

* * * * *